US006361076B1

(12) United States Patent
Lingwall

(10) Patent No.: US 6,361,076 B1
(45) Date of Patent: Mar. 26, 2002

(54) SPINNING DISK ASSEMBLY

(75) Inventor: Patricia Lingwall, Kennesaw, GA (US)

(73) Assignee: EK Success, Ltd., NJ (US)

( * ) Notice: Subject to any disclaimer, the term of this patent is extended or adjusted under 35 U.S.C. 154(b) by 0 days.

(21) Appl. No.: 09/695,740

(22) Filed: Oct. 24, 2000

(51) Int. Cl.[7] ..... B42D 15/00
(52) U.S. Cl. ..... 283/65; 283/117
(58) Field of Search ..... 283/61, 62, 65, 283/66.1, 115; 402/79; 235/78 R, 83, 88; 446/147

(56) References Cited

U.S. PATENT DOCUMENTS

| | | | | |
|---|---|---|---|---|
| 4,001,551 A | | 1/1977 | Hirsimaki | 235/70 A |
| 4,002,097 A | | 1/1977 | Leonard | 84/471 SR |
| 4,132,348 A | | 1/1979 | Bromberg | 229/75 |
| 4,137,448 A | | 1/1979 | Smith | 235/78 G |
| 4,249,757 A | | 2/1981 | Gella | 281/15 R |
| 4,262,939 A | | 4/1981 | Schoettle, Jr. | 283/65 |
| 4,419,837 A | * | 12/1983 | Meckar | 402/79 X |
| 4,454,409 A | | 6/1984 | Sehres | 235/78 |
| 4,537,576 A | | 8/1985 | Thorsheim et al. | 434/404 |
| 4,626,220 A | | 12/1986 | Kaufman et al. | 434/236 |
| 4,642,054 A | | 2/1987 | Wada | 434/178 |
| 5,057,067 A | * | 10/1991 | Hibsch | 283/65 X |
| 5,141,253 A | * | 8/1992 | Rice | 283/65 |
| 5,429,390 A | * | 7/1995 | King | 283/65 |
| 5,517,007 A | * | 5/1996 | Morgan | 283/65 X |

* cited by examiner

*Primary Examiner*—Willmon Fridie, Jr.
(74) *Attorney, Agent, or Firm*—Sofer & Haroun, LLP

(57) ABSTRACT

A spinning disk assembly including a support sheet having a window area, a center point and a slit region and also a disk having a center coupled to that center point of the support sheet, an outer circumference and a mid circumference. The mid circumference is located between the center and the outer circumference with the area between the center and said mid circumference defining a window viewing band which corresponds to the window area of the support sheet. The area between the mid circumference and the outer circumference defines a slit viewing band which corresponds to the slit region of the support sheet, so that when the center of the disk is coupled to the center point of the support sheet, part of the window viewing band is seen through the window of the support sheet and part of the slit viewing band is viewed through the slit region of the support sheet.

12 Claims, 8 Drawing Sheets

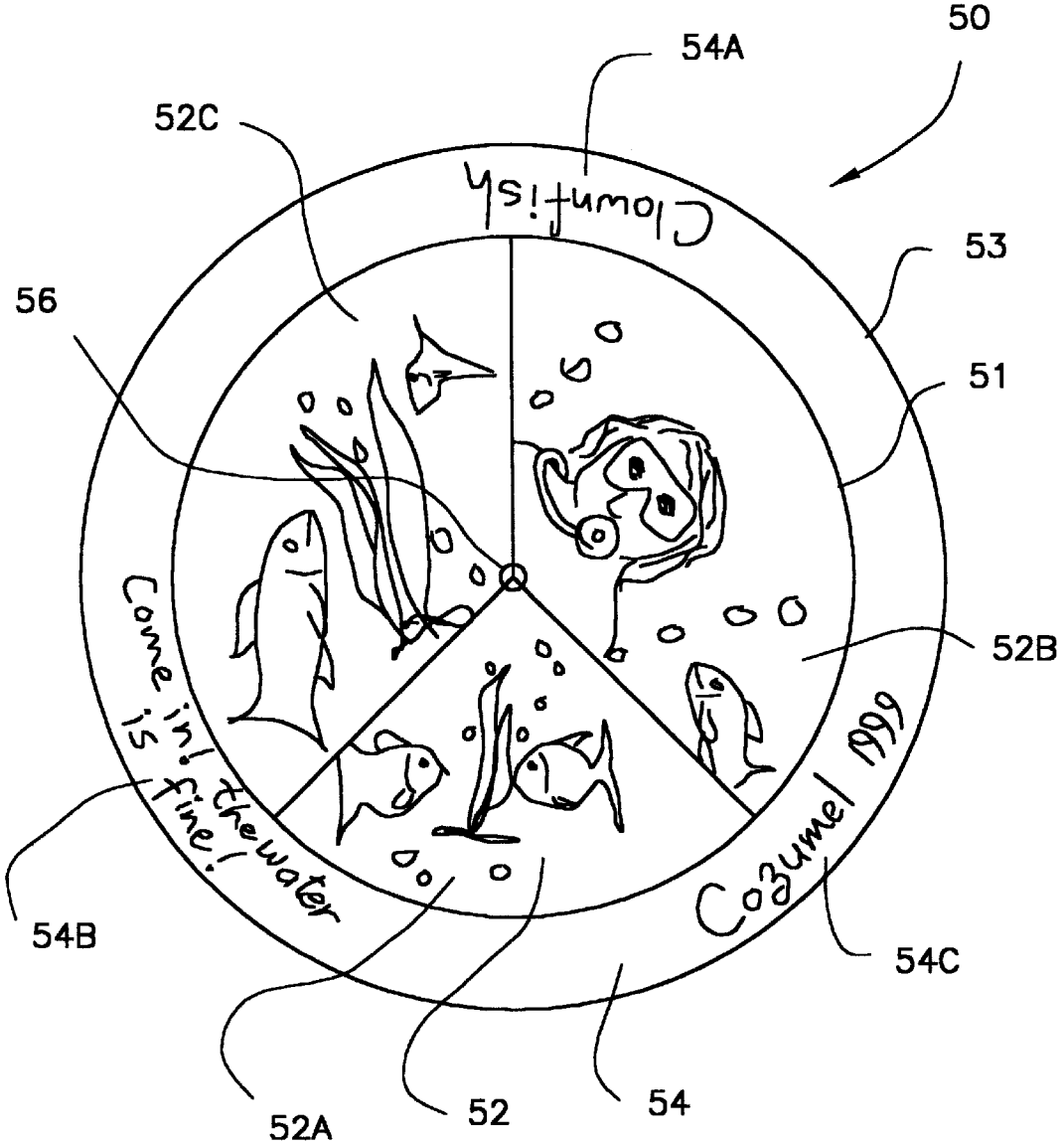
FIG, 4B

SPINNING DISK ASSEMBLY

FIELD OF THE INVENTION

This invention relates generally to a spinning disk assembly, and more particularly, to a spinning disk assembly having a disk that includes a first and second region; each region is partially and selectively visible through, respectively, a window and a slot on an attached main view page.

BACKGROUND OF THE INVENTION

Spinning disk assemblies are commonly known in the art for use as educational, leisure, and calculating devices, among other uses. Some of these prior art devices are described below. In general, spinning disk assemblies include a disk that is rotatably attached to a main sheet. The main sheet has windows that allow portions of the disk to be seen by a user while the remaining portions of the disk remain hidden by the main sheet.

As mentioned, there are many devices in the prior art that teach a spinning disk assembly. For instance, U.S. Pat. No. 4,626,220 to Kaufman et al. discloses a psychological test device for measuring the intellectual ability of children. A child is required to identify a picture that is exposed in small increments by slowly moving it behind a narrow window. The device includes a rotatable circular disk interposed between front and back face plates. The front of the disk carries a plurality of pictorial elements. The back face of the disk carries corresponding identifying indicia. A narrow window in the front face plate overlies the path of rotary movement of the pictorial information. A cut-out in one edge of the face plates, coupled with finger notches in the exposed peripheral edge of the disk, permits easy rotation of the disk. A timing scale assists the examiner in regulating the exposure time of each pictorial element being tested.

A further example is U.S. Pat. No. 4,537,576 to Thorsheim et al. which discloses an educational book that allows for interaction between graphic information contained on reference elements. The reference elements are rotatably attached to a base leaf and a second set of graphic information contained on apertured leaves. The apertured leaves superimpose the base leaf and reference elements, such that the apertures are visually aligned with the reference elements. The second set of graphic information areas are juxtaposed with respect to the apertures of the leaves to be combined with the graphic information of the reference elements visible through the apertures. To maintain this alignment, the apertured leaves and base leaf are rotatably bound together at one end by a binding mechanism.

Still another example is U.S. Pat. No. 4,002,097 to Leonard which discloses a chord inversion coordination aid. The device includes a plurality of dials of increasing diameter each of which represent a particular chord type. The dials also have a peripheral array of the scale tone names of the chord in its root and inverted positions arranged in sectors. By aligning various sectors of the discs, a given chord progression can be arranged according to the most easily played chord inversions. The dial may be centrally pivoted behind a cover sheet having a window therein to expose the dial sectors.

None of the above prior art references discloses a main sheet that includes a slot along with a window. Such a slot would allow a portion of a second region of the disk to be viewed while—through the window—a portion of a first region of the disk is viewed. In such a configuration, decorations on the portions could complement one another to enhance use for the viewer. Another problem with the prior art is that the devices often make use of a relatively large amount of material in order to carry out their function. There remains a need for a spinning disk assembly that allows a user to simultaneously view different portions of a disk.

OBJECTS AND SUMMARY OF THE INVENTION

It is thus a general object of the present invention to provide a new type of spinning disk device.

It is a primary object of the present invention to provide a simple, low cost spinning disk device.

It is a more specific object of the present invention to provide a spinning disk device that allows a user to simultaneously view different regions of a disk.

It is still another object of the present invention to provide a spinning disk device where the disk has regions that can be decorated to complement one another.

Yet another object of the present invention is to provide a device that allows for the selective viewing of portions of a rotatable disk.

Thus, according to one embodiment of the invention, a spinning disk assembly is provided with a support sheet having a window area, a center point and a slit region. The assembly also includes a disk having a center coupled to the center point of the support sheet, an outer circumference and a mid circumference, the mid circumference located between the center and the outer circumference. The area between the center and the mid circumference defines a window viewing band which corresponds to the window area of the support sheet, and the area between the mid circumference and the outer circumference defines a slit viewing band which corresponds to the slit region of said support sheet, so that when the center of the disk is coupled to the center point of the support sheet, part of the window viewing band is seen through the window of the support sheet and part of the slit viewing band is viewed through the slit region of the support sheet.

The above description sets forth rather broadly the more important features of the present invention in order that the detailed description thereof that follows may be understood, and in order that the present contributions to the art may be better appreciated. Further objects and advantages of this invention will be apparent from the following description and appended claims, reference being had to the accompanying drawings forming a part of this specification, wherein like reference characteristics designate corresponding parts in the several views. It is to be understood, however, that the drawings are designed solely for the purposes of illustration and not as a definition of the limits of the invention, for which reference should be made to the appended claims.

BRIEF DESCRIPTION OF THE DRAWINGS

With the above and additional objects and advantages in view, as will hereinafter appear, this invention comprises the devices, combinations and arrangement of parts hereinafter described by way of example and illustrated in the accompanying drawings of preferred embodiments in which like reference characters denote similar elements throughout the several views:

FIG. 4*b* illustrates a front elevational view of the disk shown in FIG. 4*a* after decorations have been applied thereon, according to one embodiment of the invention;

DETAILED DESCRIPTION OF THE INVENTION

Figure 1:
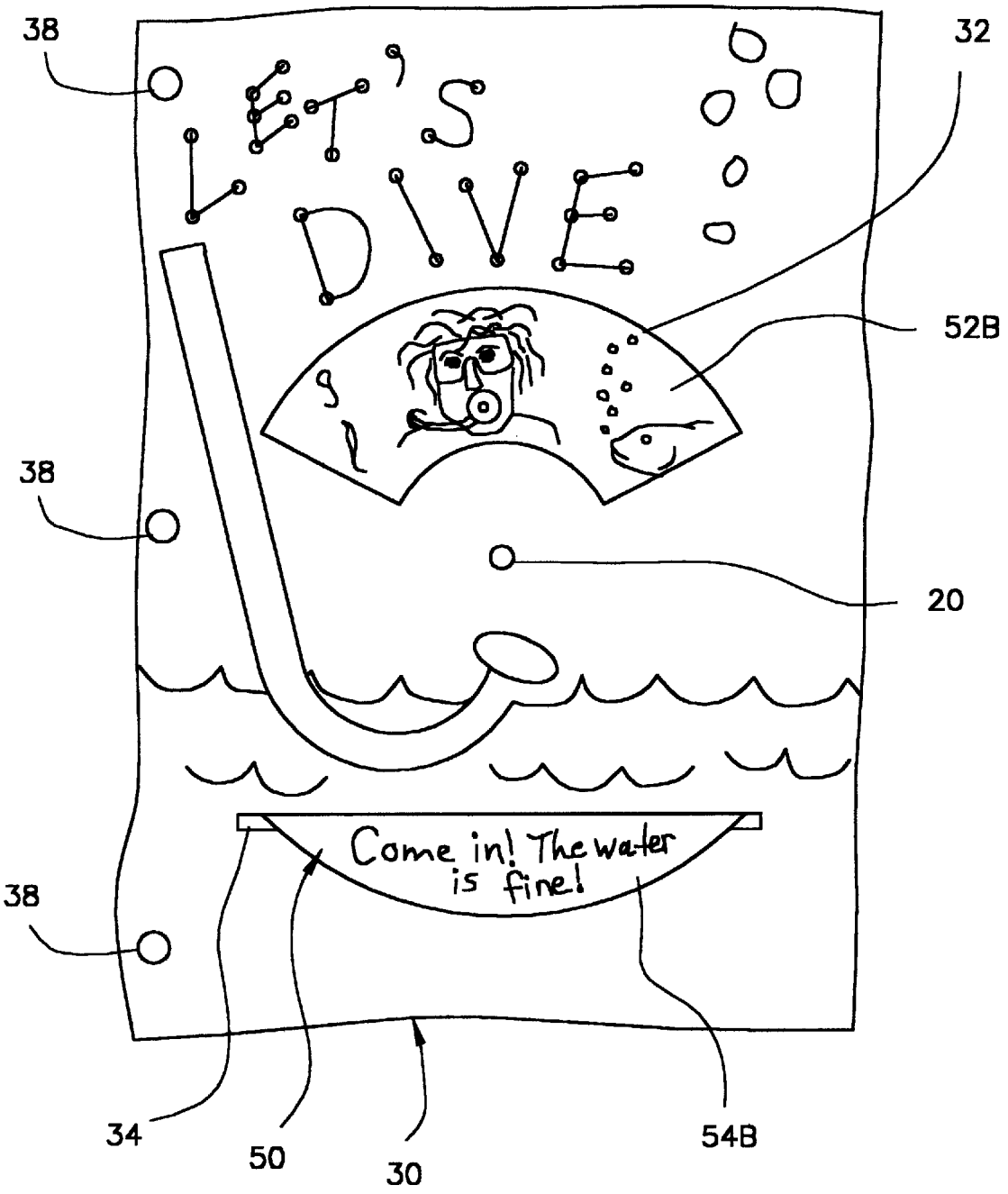
FIG. 1 illustrates a front elevational view of a spinning disk assembly according to one embodiment of the invention.
Figure 2:
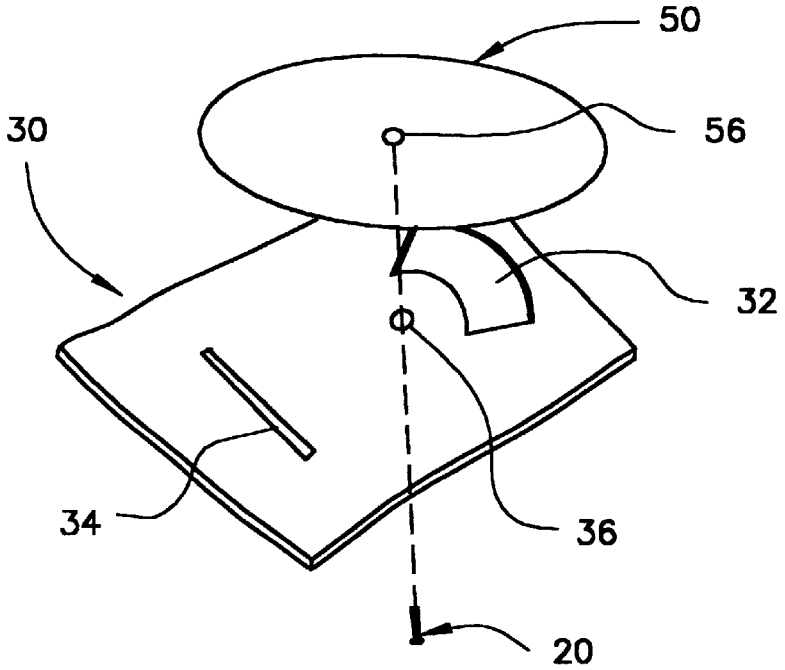
FIG. 2 illustrates an exploded rear perspective view of the spinning disk assembly shown in FIG. 1, including a disk, a main sheet view page, and a fastener, according to one embodiment of the invention.
Figure 3:
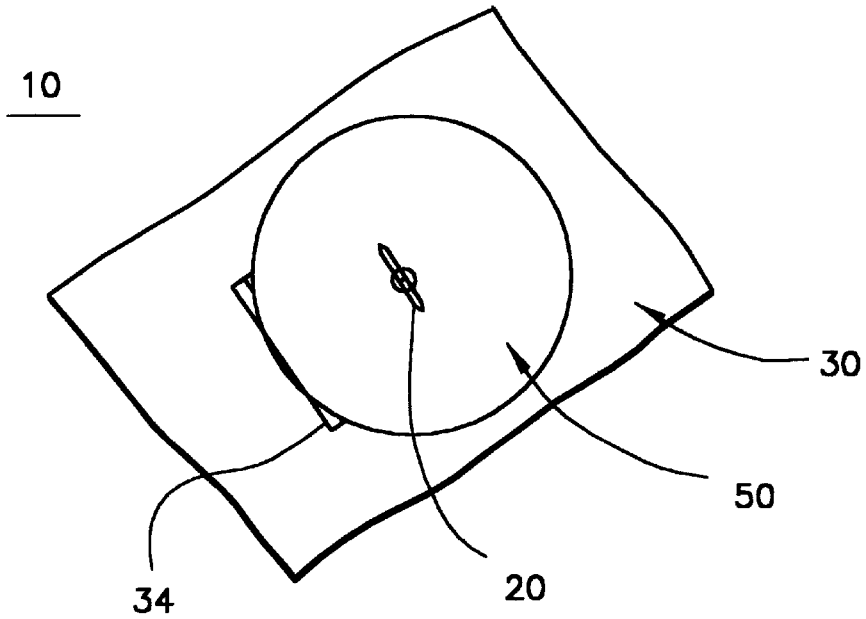
FIG. 3 illustrates a rear perspective view of the spinning disk assembly shown in FIG. 1, according to one embodiment of the invention.

Considering FIGS. 1–3, there is shown one embodiment of a spinning disk assembly 10 according to the present invention. The basic components of assembly 10 are a disk 50, a main support sheet or view page 30, and a fastener 20. However, as discussed below, other embodiments of spinning disk assembly 10 may include further components. Moreover, the configuration of assembly 10 can differ with regard to the number of windows and slots. As discussed in more detail below, fastener 20 allows disk 50 to be rotatably mounted to main sheet 30. When assembled, specific regions of disk 50 may be preferentially viewed by a user.

Figure 4A:
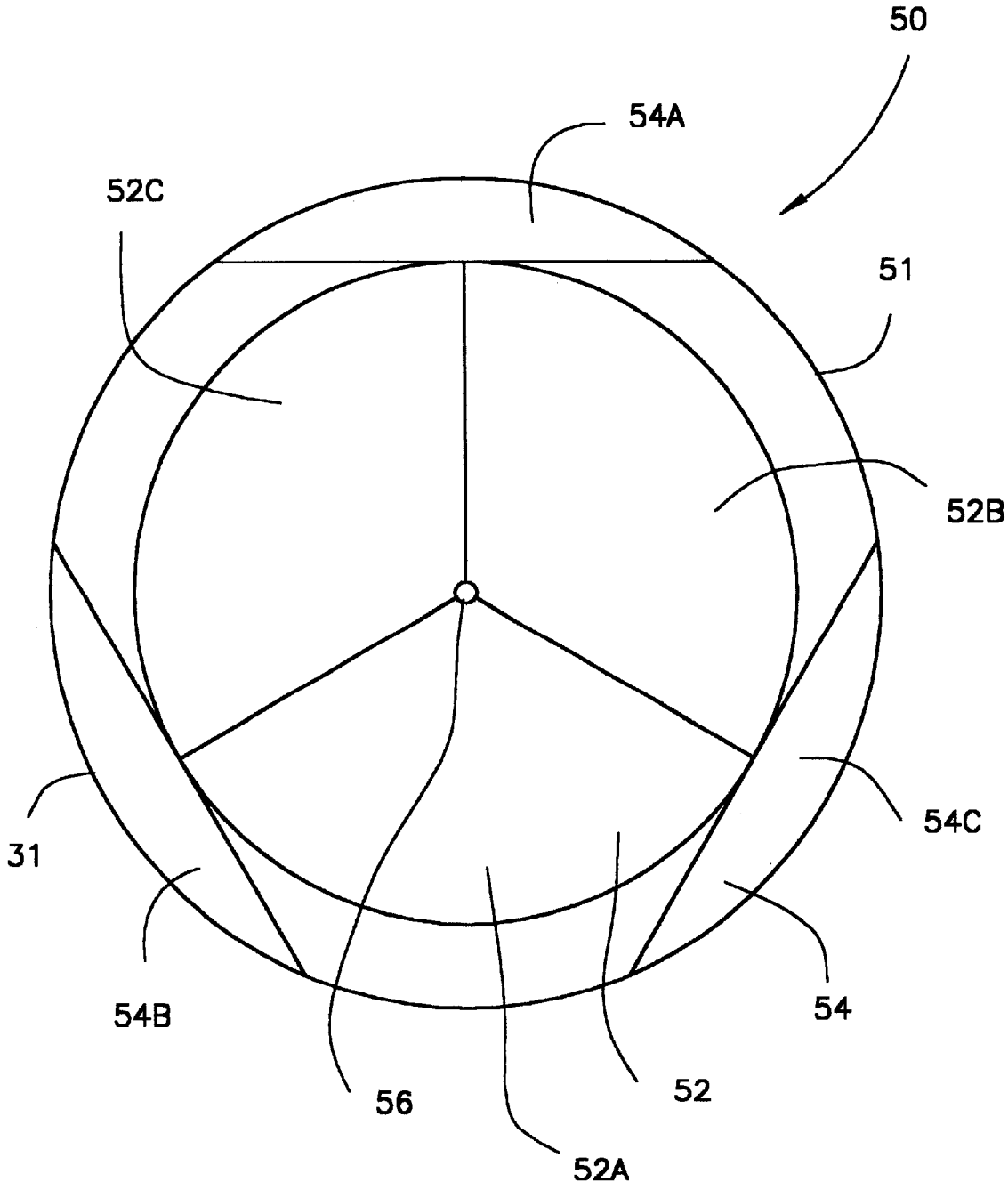
FIG. 4*a* illustrates a front elevational view of the disk shown in FIG. 2, according to one embodiment of the invention.
Figure 6:
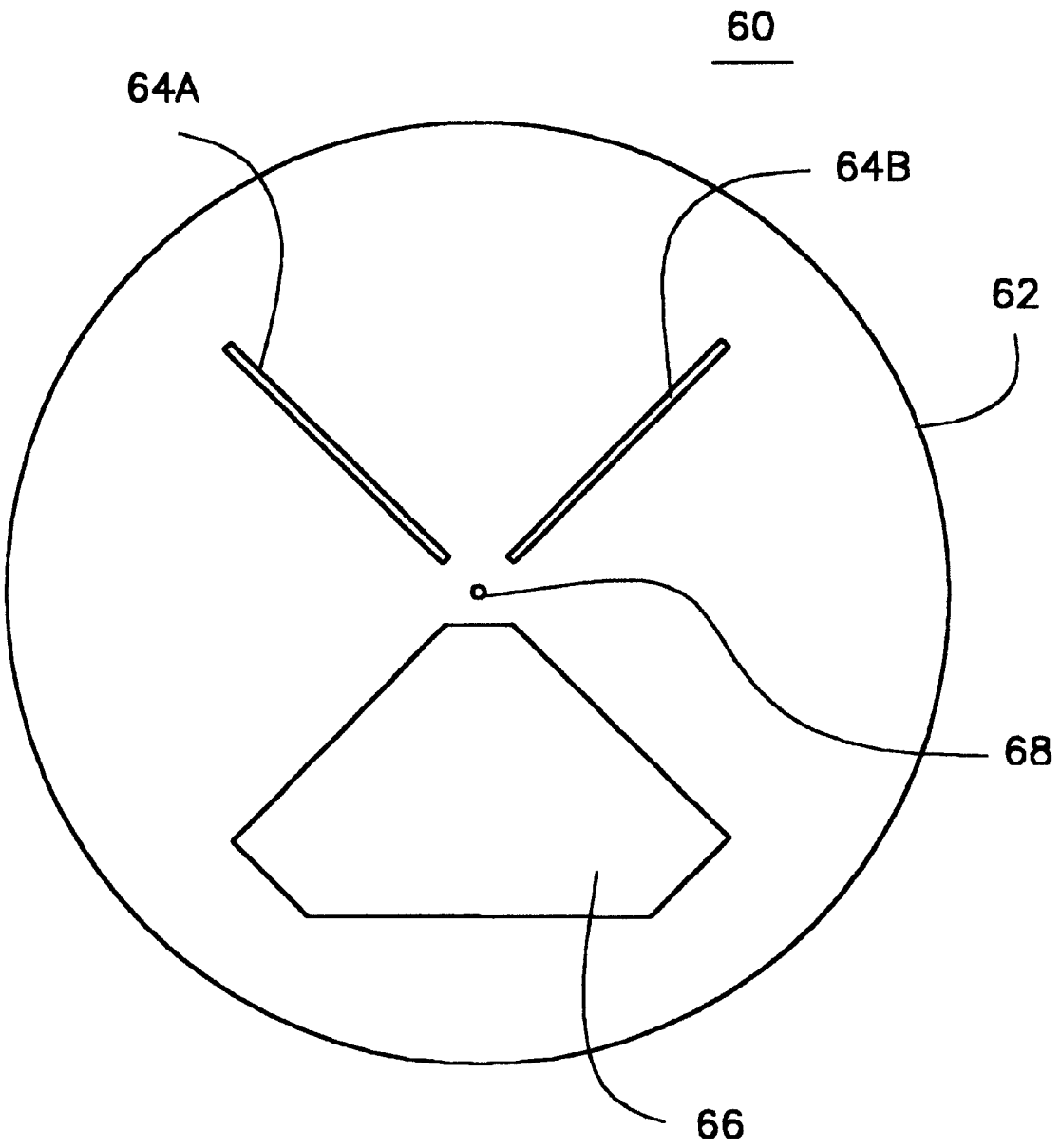
FIG. 6 illustrates a front elevational view a template used to create a disk shown in FIG. 7, according to one embodiment of the invention.
Figure 7:
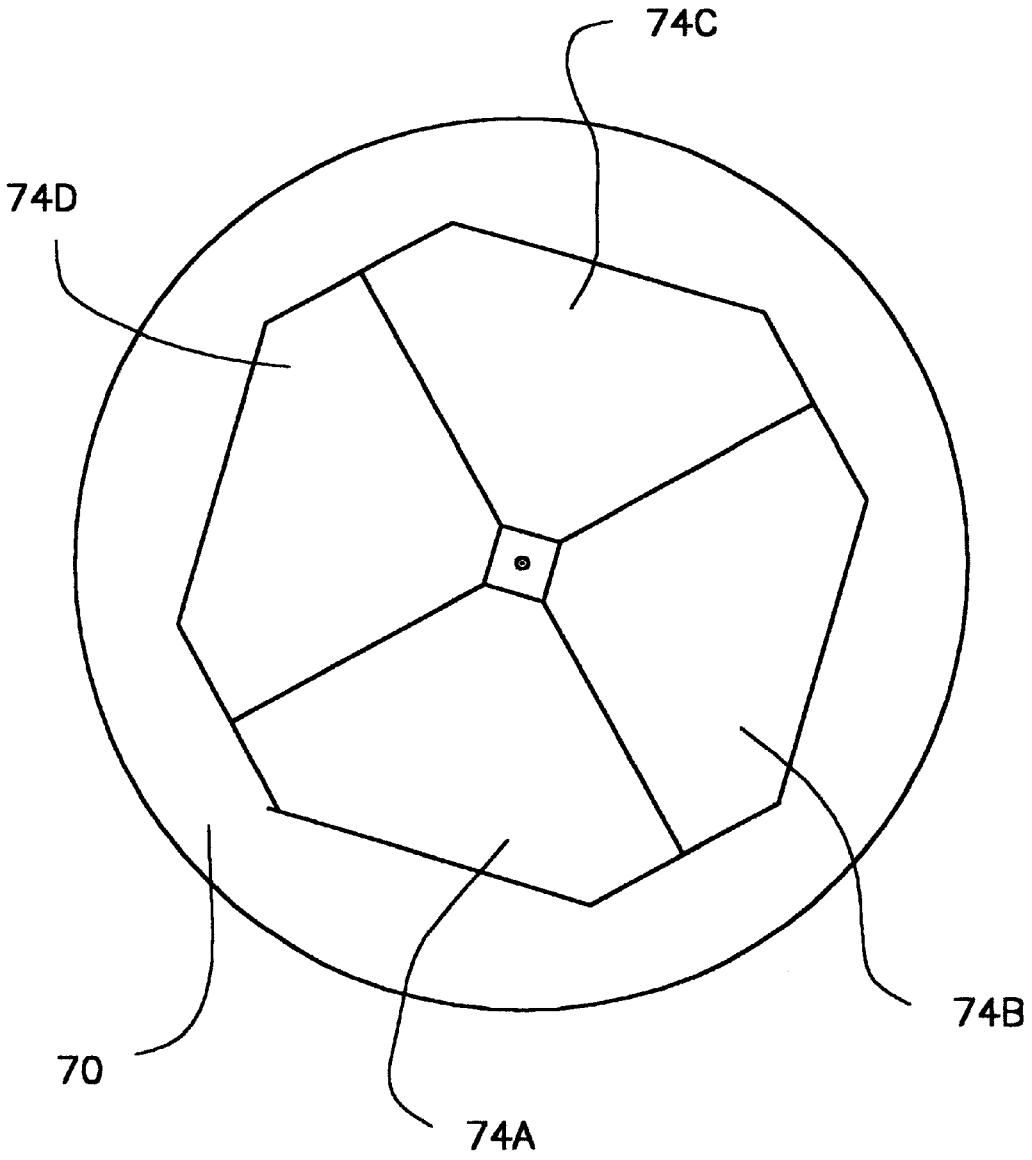
FIG. 7 illustrates a front elevational view of a disk that can be created using the template shown in FIG. 7, according to one embodiment of the invention.

Now with attention directed towards FIG. 4*a*, in the preferred embodiment, disk 50 is fabricated from paper. Although disk 50 is shown to be circular, disk 50 can be one of many shapes such as a polygon with any number of sides. Disk 50 may be provided to a user as shown. Alternatively, a user may be required to cut along printed lines (or tear along perforated lines) on a piece of paper in order to form disk 50. As described in more detail below, and as shown in FIGS. 6 and 7, a template may be provided to the user so that disk 50 may be formed by the user. In any case, a piece of cardstock (not shown) in the shape of disk 50 may be applied to disk 50 at the time of manufacture or by the user in order to strengthen and stiffen disk 50. A fastener opening 56 is centered on disk 50 through which a fastener 20, discussed below, can be inserted. Disk 50 is divided by mid circumference line 51 into a first region 52 that is centered on disk 50 and a second region 54, located between mid circumference 51 and outer circumference 31 and forms a ring about first region 52.

First region 52 may be further divided into any number of first sub-regions corresponding to the size of window 32 of main view page 30 discussed below. In this instance, region 52 is divided into three equally sized sub-regions 52*a*, 52*b*, and 52*c*. Essentially, first sub-regions 52*a*, 52*b*, and 52*c* provide guidelines so that the user can properly decorate disk 50. Likewise, second region 54 may be further divided into a number of second sub-regions corresponding to the number of first sub-regions. In this instance, region 54 is divided into three sub-regions 54*a*, 54*b*, and 54*c* that will be visible through a slot 34 in main sheet 30 and may respectively correspond (once decorated by the user) to the decorations on first sub-regions 52*a*, 52*b*, and 52*c*.

With reference now to FIG. 6, a template 60 is shown that can be used to make a disk 70 shown in FIG. 7. Preferably, template 60 is fabricated from a rigid material such as plastic. Template 60 is shown here to be circular so as to aid in forming circular disk 70. However, template 60 may be shaped in a variety of ways to produce a desired shape. Template 60 also includes opening 66 that corresponds to the desired shape of sub-regions 74*a*, 74*b*, 74*c*, and 74*d* of disk 70. These regions are analogous to the regions 52*a*, 52*b*, and 52*c*, but instead number four rather than three regions. Additionally, template 60 may include guidelines 64*a* and 64*b* that can be printed on template 60 or, in the alternative, cut therein. A center-hole 68 is also provided that is centered on template 60.

In the preferred embodiment, main sheet view page 30 as shown in FIGS. 1 and 2 is also fabricated from paper. As with disk 50, a sheet of cardstock (not shown) may be applied to main sheet 30 for the purpose of stiffening and strengthening its construction. At least one window 32 is cut on main sheet 30 so that window 32 overlays the rotational path of first region 52 of disk 50. While not shown, main sheet 30 may have additional window openings disposed thereon that also corresponds to region 52 of disk 50. Also, at least one slot 34 is disposed on main sheet 30 in a configuration that corresponds with second region 54 of disk 50. As with window openings, main sheet 30 may have additional slots disposed thereon that also correspond with region 54 of disk 50. Both window 32 and slot 34 may be cut at time of manufacture, or in the alternative, by the user. Corresponding to fastener opening 56, a fastener opening 36 is positioned on page 30 through which a fastener 20, discussed below, can be inserted.

Figure 5:
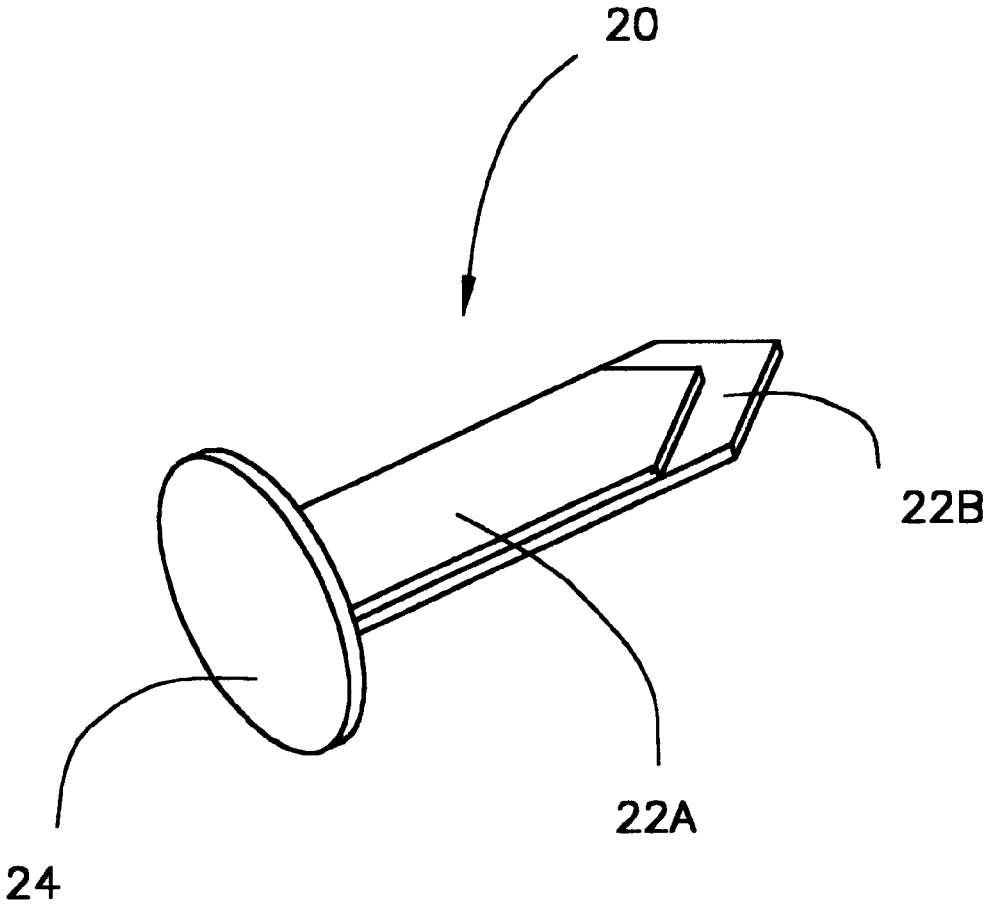
FIG. 5 illustrates a perspective view of the fastener shown in FIG. 2, according to one embodiment of the invention.

Now considering fastener 20 in more detail, in the preferred embodiment, fastener 20 is a standard paper fastener shown in FIG. 5. Such a fastener 20 is often fabricated entirely from brass and has two bendable projections 22*a* and 22*b* that are held by head 24. Head 24 is relatively larger in diameter as compared to the cross-sectional width of projections 22*a* and 22*b*. Thus, projections 22*a* and 22*b* may be passed through an appropriately sized hole (in this instance openings 36 and 56 of, respectively, page 30 and disc 50) that cannot be passed by head 24. As discussed below, fastener 20 is used to rotationally attach disc 50 to page 30. It should be understood that fastener 20 need not be configured as shown in FIG. 5. For instance, fastener 20 may instead be a rivet or other attachment means that allows disc 50 to be rotationally attached to page 30.

If necessary, a user first cuts or removes disk 50 from a larger sheet (not shown) to form disk 50 shown in FIG. 4*a* or disk 70 shown in FIG. 7. The user may use template 60 shown in FIG. 6 to aid in this step. After placing template 60 on a sheet of paper, a user traces about the circumference 62, traces within opening 66A, and marks a center point using centerhole 68. Template 60 is now rotated ninety degrees (in this instance) so that guideline 64*a* or 64*b* is aligned with lines previously drawn when tracing opening 66. Opening 66 is now retraced and, in this embodiment, this step is repeated two more times in order to create the requisite number of subregions shown in FIG. 7. A user may now apply decorations to these subregions in the form of photographs (as shown in FIG. 4*b*), cut-outs, drawings, or other similar items. The user may then apply description or further decoration to corresponding sub-regions.

Now, the user prepares main page 30, if need be, by cutting or removing portions of paper to form window 32 and slot 32. Main page 30 can now be decorated to reflect the subject matter contained on disk 50. For example, as shown in FIG. 1 and FIG. 4*b*, disk 50 includes photographs of a scuba diving excursion on first region 52 that are described in words on region 54. Thus, page 30 is thematically decorated to reflect the subject matter of disk 50.

Disk 50 is now applied to page 30 and held in place by inserting projections 22*a* and 22*b* of fastener 20 through openings 56 and 30. Projections 22*a* and 22*b* are then bent to form a 180 degree angle therebetween. Disk 50 is now rotatably fastened to page 30. A user now bends disk 50 in order to insert a portion of second region 54 through slot 34.

Figure 8:
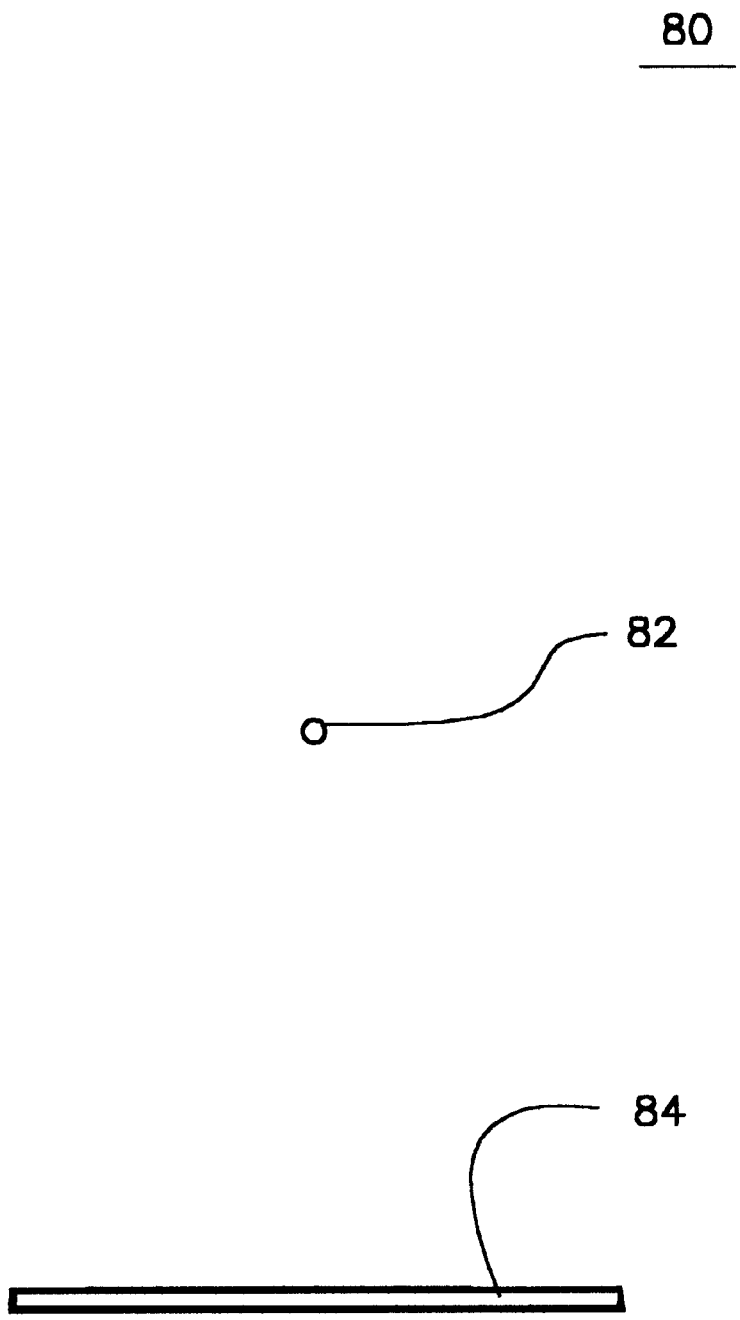
FIG. 8 illustrates a front elevational view a template used to create a protective sheath for the spinning disk assembly shown in FIG. 1, according to one embodiment of the invention.

After spinning disk assembly 10 is completely assembled as shown in FIG. 1, the user may insert assembly 10 into a scrapbook using openings 38 that are spaced to be used with a standard three-ring binder. Alternatively, the user can prepare a customized sheath utilizing a template 80 shown in FIG. 8 in conjunction with a standard, clear plastic, three hole sheet protector (not shown). The sheet protector is cut in accordance with a slot 84 and a center-hole 82. Thus, assembly 10 may be placed in the sheath and mounted therewithin using fastener 20. The portion of disk 50 exposed through slot 34 of sheet—which shown in FIG. 1—is now drawn through the slot created in the protector sheet. In either case, the user can now turn disk 50 by grasping and turning the portion of region 54 that is exposed through slot 34 of page 30. As can be seen, when sub-region 52*b* is in view through window 32, corresponding sub-region 54*b* is in view through slot 34. Thus, in this instance, a photograph of a scuba diver on sub-region 52*b* can be viewed at the same time a corresponding statement ("Come in! The water is fine!") is displayed on sub-region 54*b*.

Further embodiments of assembly 10 may include additional windows 32 along with additional corresponding slots 34 on page 30. This would allow multiple sub-regions of regions 32 and 52 to be viewed simultaneously.

While there has been shown and described particular embodiments of the invention, it will be obvious to those skilled in the art that changes and modifications can be made therein without departing from the invention, and therefore, the appended claims shall be understood to cover all such changes and modifications as fall within the true spirit and scope of the invention. Also it is to be understood that the phraseology and terminology employed herein is for the purpose of description and not of limitation.

What is claimed is:

1. A spinning disk assembly comprising:

a support sheet having a window area, a center point and a slit region;

a rotatable disk having a center coupled to said center point of said support sheet, an outer circumference and a mid circumference, the mid circumference located between said center and said outer circumference, wherein the area between said center and said mid circumference defines a window viewing band which corresponds to the window area of the support sheet, and the area between said mid circumference and said outer circumference defines a slit viewing band which corresponds to the slit region of said support sheet, so that when said center of said disk is coupled to said center point of said support sheet, part of said window viewing band is seen through said window of said support sheet and part of said viewing band protrudes through said slit region; and wherein said window viewing band comprises at least one image, and said slit viewing band comprises at least one item of text, so that when said at least one image on said window viewing band is visible through said window area, said at least one item of text protrudes through said slit region and corresponds with said image.

2. A spinning disk assembly according to claim 1, wherein said window viewing band and said slit viewing band are further comprised of sub-regions, each of said sub-regions of said first region corresponding to one of said sub-regions of said second region.

3. A spinning disk assembly according to claim 1, wherein said disk and said support sheet are fabricated from paper.

4. A spinning disk assembly according to claim 1, wherein said fastener is a metallic paper fastener.

5. A spinning disk assembly according to claim 1, wherein said fastener is a rivet.

6. A spinning disk assembly according to claim 1, wherein said support sheet further comprises a means for attachment to a scrapbook.

7. A spinning disk assembly according to claim 6, wherein said means for attachment to a scrapbook is a series of openings that correspond to binder clips on a looseleaf notebook.

8. A spinning disk assembly according to claim 1, wherein said window viewing band of said rotatable disk comprises at least a first and a second image.

9. A spinning disk assembly according to claim 8, wherein said slit viewing band comprises at least a first and a second item of text, said first image corresponding to said first item of text and said second image corresponding to said second item of text.

10. A spinning disk assembly according to claim 9, wherein said first image and said first item of text are diametrically opposed to one another.

11. A spinning disk assembly according to claim 1, wherein said window area and said slit region are disposed within said support sheet.

12. A spinning disk assembly comprising:

a support sheet having a window area, a center point and a slit region disposed within said support sheet; and a rotatable disk having a center coupled to said center point of said support sheet, said disk having an outer circumference and a mid circumference, the mid circumference located between said center and said outer circumference, wherein the area between said center and said mid circumference defines a window viewing band which corresponds to the window area of the support sheet, and the area between said mid circumference and said outer circumference defines a slit viewing band which corresponds to the slit region of said support sheet, so that when said center of said disk is coupled to said center point of said support sheet, part of said window viewing ban is seen through said window of said support sheet and part of said viewing band protrudes through said slit region; wherein said window viewing band comprises first, second and third images, said slit viewing band comprises, first, second and third items of text, so that when one of said images is viewed through said window area, only one of said items of text is visible in said slit region and corresponds with said image.

* * * * *